United States Patent [19]

Noakes

[11] 4,416,810

[45] Nov. 22, 1983

[54] DISPOSAL OF RADIOACTIVE AROMATIC LIQUID WASTES

[76] Inventor: John E. Noakes, 4295 Barnett Shoals Rd., Athens, Ga. 30605

[21] Appl. No.: 288,534

[22] Filed: Jul. 30, 1981

[51] Int. Cl.[3] ..... G21F 9/16

[52] U.S. Cl. ..... 252/628

[58] Field of Search ..... 252/628, 631

[56] References Cited

FOREIGN PATENT DOCUMENTS

| | | | |
|---|---|---|---|
| 2356253 | 5/1975 | Fed. Rep. of Germany | 252/628 |
| 2827030 | 1/1979 | Fed. Rep. of Germany | 252/628 |
| 625756 | 1/1963 | France | 252/628 |
| 54-45499 | 4/1979 | Japan | 252/628 |
| 55-95899 | 7/1980 | Japan | 252/628 |
| 1414073 | 11/1975 | United Kingdom | 252/628 |

OTHER PUBLICATIONS

Moghissi, et al., ed. 1978. Nuclear Power Waste Technology. American Society of Mechanical Engineers, New York. pp. 285–288.

Carter, et al., ed. 1979. Management of Low-Level Radioactive Waste, vol. 1. Pergammon Press, New York. pp. 419–427.

Donnet, J. and A. Voet. 1976. Carbon Black-Physics, Chemistry, and Elastomer Reinforcement. Marcel Dekker, Inc., New York. pp. 21–25, 58, and 115–117.

*Primary Examiner*—Deborah L. Kyle
*Assistant Examiner*—Howard J. Locker

[57] ABSTRACT

This invention relates to a method for the encapsulation in a cement mixture of the organic liquid radioactive waste comprising an aromatic liquid and an organic fluor, generated from the use of liquid scintillation counting (LSC).

5 Claims, No Drawings

DISPOSAL OF RADIOACTIVE AROMATIC LIQUID WASTES

BACKGROUND OF THE INVENTION

Liquid scintillation counting is an important analytical tool with extensive applications in medicine and in basic and applied research. The level of the radioactivity of the waste is relatively low, representing about 8 curies used per year on a national level with low energy beta emitters such as carbon fourteen and hydrogen three being the major contributors to such emissions.

While each LSC analysis uses a relatively small amount of liquid, in the order of 10–15 milliliters, a great number of such analyses are done each year, and the total volume of resulting liquid is substantial and presents a substantial disposal problem.

The LSC cocktail comprises an aromatic liquid, such as toluene, xylene, or benzene, with a small amount of an organic fluor such as PPO, PBD, PBBO, and other oligophenylenes known to those skilled in the art. By placing a radioactive labelled compound within the energy sensitive cocktail, the radioactivity of the compound can be measured.

At the present time, the only repository which will accept organic radioactive wastes in in Richland, Wash., and that site is scheduled to be discontinued sometime in 1982. Burning the waste is not a satisfactory disposal method because radioactive elements may be dispersed in the atmosphere. Transporting liquid waste to the state of Washington is obviously hazardous and unsatisfactory. As a result, liquid LSC waste is now being accumulated by the users and there is no satisfactory method of disposing of it. Unless a suitable and safe method is found, it is probable that the use of liquid scintillation counting will have to be drastically curtailed and permanently restricted.

The object of the present invention is to provide a method of dealing with and disposing of the wastes resulting from liquid scintillation counting analyses.

In accordance with my invention, I have discovered that LSC wastes in substantial amounts can be made into a dispersion with water in which the continuous phase is water and then mixed with Portland cement or the like to make a permanent, solid, concretelike material in which the LSC waste is well distributed and which has good compressive strength, leach, and heat resistance so that it can be transported in the solid state and stored at suitable radioactive solid storage sites.

As a general proposition, a hydrophobic organic material is not compatible with cement and, if it mixes with the cement at all, it does not mix with it in any sort of a uniform manner.

In cementing of oil wells, it is standard practice to make cement/oil/water emulsion mixtures and pump them down the well as a slurry to seal up the well. The mixture has to be fluid, and usually is compounded so that it takes an extended time to set up.

It has even been proposed that a water-in-oil emulsion be made up and mixed with cement and radioactive waste and pumped down into cavities in the ground for storage. The concept is that the cement does not begin to set up until the emulsion breaks and the water can interact with the cement. Reference is made to U.S. Pat. No. 3,62,274.

In accordance with my invention, I have discovered that more LSC liquid organic material can be incorporated in a cement than would have been thought possible, and that for reasons not now clear to me, the addition of organic material up to a certain point actually improves the compressive strength of the resulting compound. In accordance with my invention, for every 100 grams of cement, I use about 32 milliliters of water, between about 20 and 30 milliliters of the LSC aromatic liquid waste, and about 4 milliliters of a dispersing agent such as Triton X-100.

In my preferred mixing process, I first mix the dispersing agent in the LSC waste and then mix that with the water to form a white liquid dispersion which looks like milk. It is also possible to mix the dispersing agent with the aqueous phase or to mix the dispersive agent with both the aqueous and organic phases prior to forming the dispersion. The milky whiteness of the dispersion is caused by the formation of micron size micelles of toluene distributed in the continuous water phase. No special mixing procedures are necessary. The LSC waste dispersing agent mixture can readily be stirrred into the water resulting in the formation of a relatively stable dispersion which will stay unchanged up to several hours after mixing is terminated. I prefer to use about equal volumes of water and the LSC/dispersing agent mixtures, or slightly less LSC/dispersing agent mixture than water by volume. When more LSC/dispersing agent mixture by volume than water is used, the resulting solidified material loses its structural integrity.

It is well known in the art that the preferred ratio of cement to water by weight for construction applications is about 40%, by which I mean that for 100 parts by weight of Portland cement, you should use about 40 parts by weight of water. In accordance with the present invention, I use less water than that optimum amount. Surprisingly enough, however, the LSC aromatic wastes seem to increase the effectiveness of the available water or somehow permit a compound to be formed which is strong enough to achieve the desired purposes. I thus prefer at least 30% by weight water and less than 40% by weight water to the cement.

Contrary to most oil/cement slurry mixtures of the prior art, I consider the immediate rapid curing of the cement mixture to be an advantage. In other words, I do not want to delay the curing process in any way. I want a relatively thick mixture and am not concerned with pumping it anywhere or otherwise having to handle it before it sets up.

A suitable dispersing agent or surfactant is Triton X-100, made by Rohm & Haas Company. Triton X-100 is a long-chain alkyl aryl polyoxyethylene ether so constructed to contain a hydrophilic part (dissolving in water) and a hydrophobic part (dissolving in an aromatic solvent). Another suitable dispersing agent is Sterox DJ, made by Monsanto Chemical Co. Sterox DJ is a dodecyl polyoxyethylene phenol and comes as a thick gel. Still another suitable dispersing agent is Igelpal CA 720, made by GAF Corp. Igepal CA 720 is a monylphenoxypolyethylene ethanol, and is a clear, solid gel.

There should be at least about 3% by volume dispersing agent by volume of LSC waste and water.

If desired, I can add HAF, SAF, or other carbon blacks to the mixture in amounts of from about 8–15 parts by weight of the cement to improve leach resistance and provide other improved properties.

The following examples illustrate my invention.

A series of compounds were made up as indicated below comprising mixtures of Portland cement, toluene, Triton X-100, water and Westvaco'sNuchar Aqua carbon black. Toluene was used in place of LSC waste and is the full equivalent thereof for the purposes of this example.

The 4 milliliters of Triton X-100 was first stirred into the toluene and then that mixture was poured into 64 milliliters of water for the B series and into 80 milliliters of water for the S series to give a milky white dispersion, the continuous phase of which was water.

The dispersion was then mixed into 200 grams of Portland cement for the B series and 220 grams of Portland cement for the S series to make a thick paste or mortar which was cast into cardboard soil testing cylinders 3×6 in. in size. The test samples were removed from the cardboard containers after an overnight rest and then allowed to set for 28 days before being tested.

For the S series, where carbon black was also added to the mixture, the carbon black was first mixed with the Portland cement and then the dispersion was mixed into that mixture.

Test samples were made up in accordance with the following formulas:

| B Series | | | S series | | |
|---|---|---|---|---|---|
| (B1) | 200 g | cement | (S1) | 220 | cement |
| | 32 ml | toluene | | 32 ml | toluene |
| | 4 ml | Triton X-100 | | 4 ml | Triton X-100 |
| | 64 ml | $H_2O$ | | 20 g | carbon |
| (B2) | 200 g | cement | (S2) | 220 g | cement |
| | 48 ml | toluene | | 40 ml | toluene |
| | 4 ml | Triton X-100 | | 4 ml | Triton X-100 |
| | 64 ml | $H_2O$ | | 20 g | carbon |
| | | | | 80 ml | $H_2O$ |
| (B3) | 200 g | cement | (S3) | 220 g | cement |
| | 48 ml | toluene | | 48 ml | toluene |
| | 4 ml | Triton X-100 | | 4 ml | Triton X-100 |
| | 64 ml | $H_2O$ | | 20 g | carbon |
| | | | | 80 ml | $H_2O$ |
| (B4) | 200 g | cement | | | |
| | 56 ml | toluene | | | |
| | 4 ml | Triton X-100 | | | |
| | 64 ml | $H_2O$ | | | |
| (B5) | 200 g | cement | | | |
| | 64 ml | toluene | | | |
| | 4 ml | Triton X-100 | | | |
| | 64 ml | $H_2O$ | | | |

STRUCTURAL INTEGRITY TESTS

The structural integrity of test samples was measured on a Baldwin Universal Testing 400,000-pound capacity machine to determine the maximum compressive loads for three cylinder samples from each of the eight different mixes in the B and S series. The cylinders were loaded in compression until failure. The maximum loads were divided by the cylinder's area to give the ultimate compressive stress for each sample.

The testing procedure was as follows: (1) each sample was weighed to check uniformity; (2) each cylinder was measured to determine its cross-sectional area; (3) each cylinder was capped with a sulfur compound to assure that the cylinder ends were flat and parallel so that compressive testing would provide uniform stress; and (4) each cylinder was loaded in compression until failure in a 400,000 pound capacity Baldwin Universal Testing Machine. Test results were as follows:

TABLE 1

| Sample | Average Ultimate Compressive Stress<br>Ultimate compressive stress ($f'_c$)<br>(average of 3 tests, psi) |
|---|---|
| B-1 | 2,350 |
| B-2 | 3,120 |
| B-3 | 3,180 |
| B-4 | 2,500 |
| B-5 | 1,860 |
| S-1 | 1,860 |
| S-2 | 2,660 |
| S-3 | 2,800 |

FLAME TESTING

Flammability testing comprised placing the cylinder samples in a fume hood and exposing each cylinder to a butane torch flame for one-half hour. Surface temperatures of the cylinder in direct contact with the flame reached 375° C. and exhibited a visible incandescent property. No ignition was evident for six of the cylinders tested. A slight lightening in color after testing was visible at the cylinder's surface which was in the immediate area of direct flame contact. Initial heating did produce some evolution of steam, which diminished and terminated as heating continued. No visible cracks or cylinder deformation was evident on the surface of any of the cylinders after testing.

ORGANIC SOLVENT LEACHABILITY

B-4 and S-2 formulation samples were made up and cast into duplicate 3×6-inch cylinders. Curing of the cylinders was carried out for 28 days prior to initiating the leaching studies.

The procedure followed for determining the gaseous and liquid release of toluene solvent during aqueous leaching was to place each cylinder in a 4000 milliliter volume sealable container which contained 1000 milliliters of distilled water. This volume of water was selected as it fully covered the cylinders and yet left adequate void space above for collection of released gases. The containers were also uniquely designed so as to allow syringe extraction of the head gas or water without opening to the atmosphere.

Aqueous leaching of the solid waste cylinders was carried out for multi-successive seven-day leach periods. After each seven days, a 1-milliliter water sample and a 25-microliter gas sample were extracted for analysis. The aqueous samples were mixed with carbon disulfide as a carrier and measured by gas chromatography. The gaseous samples were measured in the same manner without carrier.

Analyses were carried out by the University of Georgia Cooperative Extension Pesticide Laboratory using a Tracor model 550 Gas Chromatograph equipped with a flame ionization detector and a FFAP glass packed column. Samples were run isothermally at 35° and 300° C., respectively, using a nitrogen gas carrier at a flow rate of 10 milliliters per minute. Concentration levels of the leached toluene in the liquid and gaseous samples were determined by comparison with known standards. The data collected from the leachability studies is tabulated in Table 2.

TABLE 2

| Leach period | Leachable Toluene Solvent in Gaseous and Aqueous Phases: Gaseous μg/cc S-2 | Gaseous μg/cc B-4 | Aqueous (ppm) S-2 | Aqueous (ppm) B-4 |
|---|---|---|---|---|
| 04/04 | 8.6 | 9.1 | 9.2 | 13.5 |
| 04/09 | 4.6 | 5.9 | 19.0 | 18.5 |
| 04/16 | 2.5 | 2.5 | 9.6 | 5.0 |
| 04/24 | 1.4 | 0.84 | 1.4 | 0.84 |
| 06/24 | 1.0 | 0.15 | 1.2 | <0.05 |
| 07/02 | 0.44 | 0.15 | 2.96 | <0.05 |
| 07/15 | 0.85 | 0.17 | 2.12 | <0.05 |

RADIOACTIVE LEACHABILITY

B-4 and S-2 formulation samples were made up containing known amounts of four radionuclide-labeled compounds. These comprised water—$^{3}H$, toluene—$^{3}H$, sodium bicarbonate—$^{14}C$, and toluene—$^{14}C$. These compounds were selected as most representative of both aqueous, organic, and inorganic compounds typically found in LSC solvent waste.

The procedure followed in incorporating the labeled compounds into the solid waste was to first mix the radioactive-labeled compounds with their like unlabeled compounds. All the liquid components of the LS cocktail were next mixed and added to the cement mix, as previously described. The cement mixture was cast into 3×6-inch cylinders and allowed to cure for 28 days prior to initiating the leaching studies.

The leaching experiments were carried out in identical containers as those used for the organic solvent leachability studies. The solid waste cylinders were placed in individual containers in which 1000 milliliters of distilled water was added so as to completely immerse the cylinder. The leaching continued over a 7-day period, at which time an aliquot of water was withdrawn for radiometric analyses of the aqueous as well as organic constituents. The containers were emptied, the cylinders weighed, and the containers refilled for another 7-day leach period.

Analysis of the aqueous and soluble inorganic compounds in the leach water was carried out by extracting 25 milliliters of leach water and adjusting its pH between 6–7 with nitric acid. Two milliliters of the neutralized water was pipetted into an LS vial containing 18 milliliters of Monophase-40 LS cocktail and the sample counted in a Searle analytic Δ300 LS counter using the tritium channel and the carbon-14 channel set above tritium.

After counting of the sample, a known amount of tritium standard was added and the sample was recounted. Then a known amount of carbon-14 was added and the sample was counted for the third time. Simultaneous equations were used to solve for the amount of tritium and carbon-14 present in the sample. These values were corrected to reflect the total radionuclides present in the leachate and the percent of leachability was calculated from the solid waste. Table 3 indicates the percent leachability for the various leach time intervals.

TABLE 3

| Leach Period | Aqueous Phase Radioactivity of Leached B-4 and S-2 Solid Waste: B-4 (% leachability) H-3 | B-4 C-14 | S-2 (% leachability) H-3 | S-2 C-14 |
|---|---|---|---|---|
| 04/04 | 11.1 | $1 \times 10^{-3}$ | 2.85 | $3 \times 10^{-4}$ |
| 04/09 | 4.9 | $2 \times 10^{-3}$ | 3.85 | $1 \times 10^{-3}$ |
| 04/16 | 2.9 | $9.6 \times 10^{-2}$ | 1.11 | $8.1 \times 10^{-2}$ |
| 04/23 | 1.76 | $1.74 \times 10^{-1}$ | $9.8 \times 10^{-1}$ | $1.4 \times 10^{-1}$ |
| 06/23 | $9 \times 10^{-1}$ | N.D. | — | — |
| 06/30 | $7 \times 10^{-1}$ | N.D. | $6.7 \times 10^{-1}$ | Not detectable |

Analysis of the organic component in the leach water was carried out by transferring the remaining 975 milliliters of leach water to a 1000 milliliter separatory funnel. Four milliliters of toluene were added, shaken, and allowed to separate. The separated toluene was transferred to another flask and three more 4-milliliter toluene extractions were made in the same manner on the leach sample. The 16 milliliters of toluene extract was allowed to stand overnight to further dewater and transferred to a tared LS vial and weighed for recovery of toluene. Four milliliters of LS cocktail were added to the vial and the sample counted in a Searle Analytic Δ300 LS counter using a tritium and carbon-14 channel setting.

After counting, a known amount of tritium standard was added to the vial and the sample recounted. After recounting, a known amount of carbon-14 standard was added to the vial and the sample counted for a third time. Simultaneous equations were used to solve for the amount of tritium and carbon-14 present in the leachate, which enabled calculation of the percent leachability from the solid waste. Table 4 shows the calculated percent leachability in the organic phase of S-2 and B-4 solid waste tested.

TABLE 4

| Leach Period | Organic Phase Radioactivity of Leached B-4 and S-2 Solid Waste: B-4 (% leachability) H-3 | B-4 C-14 | S-2 (% leachability) H-3 | S-2 C-14 |
|---|---|---|---|---|
| 04/04 | $1 \times 10^{-2}$ | $1 \times 10^{-2}$ | $7 \times 10^{-3}$ | $7 \times 10^{-3}$ |
| 04/09 | $4 \times 10^{-3}$ | $4 \times 10^{-3}$ | $3 \times 10^{-3}$ | $3 \times 10^{-3}$ |
| 04/16 | $1.4 \times 10^{-5}$ | $2.4 \times 10^{-5}$ | $1.6 \times 10^{-3}$ | N.D. |
| 04/23 | $6.0 \times 10^{-4}$ | $1.1 \times 10^{-3}$ | $1.0 \times 10^{-3}$ | $5 \times 10^{-4}$ |
| 06/23 | $3.9 \times 10^{-4}$ | $1.1 \times 10^{-3}$ | $1.3 \times 10^{-4}$ | $1.0 \times 10^{-3}$ |
| 06/30 | $2.5 \times 10^{-4}$ | $5 \times 10^{-4}$ | $4.5 \times 10^{-5}$ | $8.0 \times 10^{-4}$ |

The structural integrity of the eight different B and S series solid waste mixes tested indicate they all could be expected to possess very satisfactory load capacity characteristics when encased in 55-gallon steel disposal drums. The calculated ultimate axial load capacity (load perpendicular to top surface) ranged from a low of 1,065,000 psi to a high of 1,820,750 psi. The eccentric axial load (slightly tipped), calculated with a safety factor of 4, ranged from 190,000 pounds to 324,000 pounds. Both these values strongly indicate that the steel drum encased solid waste should present little hazard of rupture either during transport or permanent storage.

The degree of organic solvent leachability of the solid waste when immersed in water was of primary concern, as it was felt that groundwater leaching would constitute the primary means by which the solvents could breach the burial site. The initial aqueous toluene values for B-4 were 13.5 ppm and for S-2 were 9.2 ppm. After the end of the seventh leach period, these values dropped to 0.88 ppm for B-4 and 2.12 ppm for S-2. The results clearly shown that the solid waste possesses good initial retention for both the liquid and gaseous LS toluene solvent and that this capability progressively increases with the cure time of the cement mixes.

Radioactive leachability testing was carried out in a very similar manner to the organic solvent evaluation in that the B-4 and S-2 solid waste cylinders were immersed for six successive 7-day leach periods. The main difference was that each solid waste mix had a designated amount of radioactive C-14 and H-3 labeled materials blended into their mixes prior to solidification. The initial radioactivity values for the aqueous phase from the first 7-day leach period showed the B-4 sample to have leached 11.1% of its H-3 and $1\times10^{-3}$% of its C-14 content . The S-2 sample in the same period leached 2.85% of its H-3 and $3\times10^{-4}$% of its C-14. At the end of the sixth 7-day leach period, the B-4 mix leached only $7\times10^{-1}$% for H-3 and no detectable amount for the C-14 and the S-2 mix was reduced to $6.7\times10^{-1}$% for H-3 and no detectable amount for C-14. In the organic phase, the B-4 sample in its initial 7-day period leached $1\times10^{-2}$% for H-3 and $1\times10^{-2}$% for C-14. At the termination of the sixth 7-day period, B-4 leached only $2.45\times10^{-4}$% for H-3 and $5\times10^{-4}$% for C-14, and S-2 was lowered to $4.5\times10^{-5}$% for H-3 and $8.0\times10^{-4}$% for C-14. This data clearly parallels that found for the organic solvent leachability in that while the solid wastes' initial retention of radioactivity is acceptable, this capability increases immeasurably as the cure period of the concrete mix is extended to longer periods of time.

Of the spectrum of solid wastes tested, the B-4 mix would appear to possess slightly superior qualities, and should be considered the preferred choice of the mixes. These qualities include excellent structural integrity, no indication of flammability or ignition of the solid waste on direct flame exposure or elevated temperatures, and good retention of encapsulated and radioactive compounds even under aqueous leaching. Extending the cure time to 60 days prior to permanent storage so as to enhance solvent retention seems advisable.

It is probable the solvent and radioactive leachability of the solid waste in the bulk form will be considerably lower than the data gathered from the 3×6-inch cylinders due to reduced surface-to-volume ratio of the 55-gallon drum (factor of 7). Values calculated for the structural integrity of the solid waste, even with a safety factor of 4, indicate good assurance of safe rupture, free transport, and permanent storage.

My procedure for solvent encapsulation requires minimum handling and should ensure little exposure of personnel to solvent fumes or chance of solvent spillage.

While the focus of the invention is on LSC waste material, it could have application to any waste material with similar organic or aqueous makeup, whether or not it was radioactive.

On balance, I favor the B series without filler over the S series with carbon black. The advantages of the carbon black are marginal and do not justify the increased cost. For some applications, however, carbon black or other additives may be desirable. Additives to consider using in my invention in place of carbon black are silica, bentonite, fuller's earth and a spectrum of plastic compounds. The purpose of the additive is to help absorb and contain the organic components of the LSC waste or equivalent.

Mixtures made in accordance with the present invention are preferably cast into 55-gallon drums. They can, of course, be cast into other forms and containers. The shape should be one with minimum surface area, by which I mean cylindrical, cubic, round or the like. I prefer a strong container because it may take up to 60 days for the mixture to reach its optimum properties. If the mixture is in a strong container, the possibilities of inadvertent mishaps are greatly reduced.

In accordance with my invention, the mixture should be compounded to provide a compressive strength of at least 2000 psi after a 28-day cure. If the mixture is this strong, it will have the necessary leach resistance and other features required for its intended purposes.

EXTRACTION OF RADIOACTIVITY FROM L.S. WASTE

In still another series of experiments an attempt was made to reduce the radioactivity of the LS waste prior to any treatment procedure to solidify the waste.

A set of experiments were carried out by first obtaining a composite radioactive LS waste from the University of Georgia waste storage facility. A measurement of the radioactivity level of this waste was carried out using a Picker 220 liquid scintillation counter with a wide open discriminator window and was found to be 6,7000 counts per minute per milliliter (cpm/ml) of waste.

An aliquot of this waste was heated to greater than 40° C. in a hot water bath so as to help break down any aqueous-oil emulsion present in the LS waste and thereby enhance an aqueous phase separation. To this heated LS waste, an equally heated aqueous saturated NaCl salt solution was added in the amount of 20% of the solvent waste volume. The two solutions were mixed in a separatory flask for 10 minutes under agitation. On standing, the solution mixture separated into two separate phases. The LS waste rose to the surface and the aqueous salt solution settled to the bottom and was extracted off. Radioactive measurement of the extracted LS waste showed a decrease in radioactivity to 3,850 cmp/ml.

A second extraction step of the once-treated LS waste was carried out in an identical manner as described for the first extraction. On checking the radioactivity of the LS waste after the second treatment it was found to contain essentially the same activity level of 3,800 cpm/ml. It was hence concluded that further aqueous salt solution extraction would be ineffective in reducing the extractable radioactivity level of the LS waste.

An additional extraction procedure involving the use of activated carbon of the Westvaco's Nuchar Aqua series possessing a surface area of greater than 2000 square meters per gram was used. In this procedure the twice extracted LS waste was heated to greater than 40° C. in a water bath and activated carbon added in an amount of 1% of the weight of the LS waste. A heated saturated aqueous NaCl solution in a volume of 20% of the LS waste was added and the mixture agitated in a separatory flask.

After mixing, the LS waste and activated carbon rose to the surface in a single phase separating from the aqueous salt solution which was extracted off. The LS waste was separated from the activated carbon by filtration with a 0.45 μm millipore filter. The LS waste was tested for its radioactivity and found to contain an activity level of 1,490 cpm/ml of LS waste.

To determine if further radioactive extraction was possible, an additional extraction using the activated carbon and saturated salt solution as previously described was tried. The radioactivity of the LS waste was only marginally lowered and the extraction treatment terminated. Table 5 shows the reduction in radioactivity level of the LS waste from the four extraction tests.

TABLE 5

Extraction of Radioactivity from L.S. Waste Prior to Solidification Treatment

| L.S. Waste | Radioactivity level counts per minute per milliliter of L.S. waste (cpm/ml) | Percent total radioactivity extracted |
|---|---|---|
| 1. Untreated L.S. waste | 6700 | 0 |
| 2. L.S. waste after first extraction with aqueous salt solution | 3850 | 42.5 |
| 3. L.S. waste after second extraction with aqueous salt solution | 3800 | 42.8 |
| 4. L.S. waste after first extraction with activated carbon and aqueous salt solution | 1490 | 77.8 |
| 5. L.S. waste after second activated carbon aqueous salt solution extraction | 1410 | 79.0 |

These extraction experiments demonstrate several important properties inherent to the L.S. wastes. First is that there is present a considerable amount of radioactivity associated with an emulsified water phase in the waste which can be isolated and separated with the application of heat and mixing with an aqueous salt solution. The second interesting property of the waste is that an additional amount of radioactivity is associated with dissolved or particulate material which can be removed by intimate mixing with a high surface area material such as activated carbon.

Prior removal of radioactivity from the LS waste is not mandatory for the successful application of the waste solidification procedure described in this patent application. Its application is envisioned where the radioactivity of the LS waste is of an usually high level and a need could exist to reduce this level prior to treatment, or that a specific radioisotope exists in the waste that requires extraction prior to solidification treatment.

The disposal of the extracted radioactivity contained in the aqueous-activated carbon fraction can be accomplished by readily mixing these materials with Portland cement to form a solid cement waste. The advantage of this form of waste over the dispersion is that a much higher amount of the aqueous waste can be tolerated in a cement solid waste than can in using the dispersion waste, thereby resulting in the production of a less expensive solid waste residue.

Having thus described my invention, what I claim is:

1. A process for solidifying radioactive wastes comprising an aromatic liquid and an organic fluor, comprising the steps of:

(1) making a dispersion of the waste and water, in which at least half of the dispersion by volume is water, at least 3% of the dispersion by volume is a surfactant, and the continuous phase is water (2) mixing the thus-formed dispersion with Portland cement so that for every 100 parts by weight of cement, there is between 30 and 40 parts by weight of water, said water being from the dispersion (3) casting the thus-formed mixture into suitable containers and allowing it to set up (4) transporting the set-up cement-like mixture to a suitable disposal site and (5) leaving the set-up cement-like mixture at the disposal site for permanent disposal.

2. The process of claim 1 in which between 10 and 20 parts by weight of an activated carbon black is added to the mixture for every 100 parts by weight Portland cement.

3. The process of claim 1 in which surfactant concentration is in the range of 2% to 10% of the dispersion volume.

4. A stable, leach proof cement-like product made in accordance with the process of claim 1, said product having a compressive strength of at least 2000 psi.

5. A process of encapsulating aromatic radioactive wastes comprising an aromatic liquid and an organic fluor, comprising the steps of mixing the wastes with water to form an unstable dispersion wherein water is the continuous phase and comprises at least one half of the dispersion by volume; mixing the thus-formed dispersion with Portland cement whereby 30 and 40 parts by weight of water is present in the mixture from the dispersion for every 100 parts by weight of cement; and allowing the mixture to set up, such mixture immediately setting up on mixing by interaction of the cement and continuous phase of the dispersion, leaving a dispersed waste uniformly distributed throughout the cement-like mixture which hardens within six hours.

* * * * *